US006601940B2

(12) United States Patent
Akama et al.

(10) Patent No.: US 6,601,940 B2
(45) **Date of Patent: *Aug. 5, 2003**

(54) HEAD, RECORDING APPARATUS HAVING THE HEAD, METHOD FOR IDENTIFYING THE HEAD, AND METHOD FOR GIVING IDENTIFICATION INFORMATION TO THE HEAD

(75) Inventors: Yuichiro Akama, Yokohama (JP); Yasuyuki Tamura, Yokohama (JP); Mineo Kaneko, Tokyo (JP); Masayoshi Tachihara, Chofu (JP); Shuichi Murakami, Kawasaki (JP); Michinari Mizutani, Tokyo (JP); Takashi Inoue, Tokyo (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,293

(22) Filed: Nov. 13, 1998

(65) Prior Publication Data

US 2002/0126170 A1 Sep. 12, 2002

(30) Foreign Application Priority Data

Nov. 14, 1997 (JP) ..... 9-313441
Nov. 14, 1997 (JP) ..... 9-313442

(51) Int. Cl.[7] ..... B41J 29/393

(52) U.S. Cl. ..... 347/19; 347/12

(58) Field of Search ..... 347/19, 49, 12

(56) References Cited

U.S. PATENT DOCUMENTS

| | | | | |
|---|---|---|---|---|
| 4,555,619 A | | 11/1985 | Anderson | 235/492 |
| 5,086,216 A | | 2/1992 | Mollet et al. | 235/492 |
| 5,363,134 A | * | 11/1994 | Barbehenn et al. | 347/49 |
| 5,610,635 A | * | 3/1997 | Murray et al. | 347/19 |
| 5,831,649 A | * | 11/1998 | Watrobski et al. | 347/19 |

FOREIGN PATENT DOCUMENTS

| | | | |
|---|---|---|---|
| DE | 3526061 A | 1/1987 | |
| EP | 0547921 A | 6/1993 | B41J/2/175 |
| EP | 0571093 A | 11/1993 | 347/47 |
| EP | 0610965 A | 8/1994 | 347/47 |
| EP | 0765762 A | 4/1997 | 347/47 |
| EP | 0766195 A | 4/1997 | 347/19 |
| JP | 8202077 | 8/1996 | G03G/9/08 |

* cited by examiner

*Primary Examiner*—Thinh Nguyen
*Assistant Examiner*—Julian D. Huffman
(74) *Attorney, Agent, or Firm*—Fitzpatrick, Cella, Harper & Scinto

(57) ABSTRACT

A head is provided with a driving signal line having a driving terminal for receiving a driving signal sent from an apparatus to the head, and an identification terminal. The driving signal line is electrically connected to the identification terminal. With the use of the driving signal line and the identification terminal, the head is identified.

7 Claims, 12 Drawing Sheets

ARRANGEMENT OF PRESS-FIT PADS

CHIP SIDE (DISCHARGE SIDE)

| | | | | | | | |
|---|---|---|---|---|---|---|---|
| 1 | BE0 | 10 | VH | 19 | VH | 28 | VH |
| 2 | A-Data1 | 11 | A-HE | 20 | B.G | 29 | BE1 |
| 3 | A-Data2 | 12 | A-SHE | 21 | DiK | 30 | A-Di2A |
| 4 | B-HE | 13 | B-Data1 | 22 | A-Di1A | 31 | A-Rank |
| 5 | B-Di2A | 14 | GND | 23 | GND | 32 | GND |
| 6 | CLK | 15 | B-Data2 | 24 | B-SHE | 33 | B-Rank |
| 7 | Vdd | 16 | B-Di1A | 25 | C-HE | 34 | ID |
| 8 | C-Di2A | 17 | C-Data1 | 26 | C-SHE | 35 | C-Data2 |
| 9 | BE3 | 18 | BE2 | 27 | C-Di1A | 36 | C-Rank |

SIGNALS COMMON TO THREE CHIPS
BE0~3, CLK, B.G, Dik, Vdd, GND, VH
SIGNALS PROVIDED FOR EACH OF THREE CHIPS
HE, SHE, Rank, Di1A, Di2A, Data1, Data2

| FIG. 4A |
|---|
| FIG. 4B |

FIG. 5

PATTERN CUT CONDITIONS ( × : CUT, ○ : CONNECTED)

| IDENTIFICATION NUMBER | GND | BE0 | BE1 | BE2 | BE3 |
|---|---|---|---|---|---|
| 1 | ○ | × | × | × | × |
| 2 | × | × | × | × | × |
| 3 | × | ○ | × | × | × |
| 4 | × | × | ○ | × | × |
| 5 | × | × | × | ○ | × |
| 6 | × | × | × | × | ○ |

FIG. 6

IDENTIFICATION BY OUTPUTS OBTAINED
WHEN SIGNALS ARE SENT FOUR TIMES

H:HIGH, L:LOW

| | TERMINAL(S) SET TO HIGH | | | | IDENTIFICATION NUMBER |
|---|---|---|---|---|---|
| | BE0 | BE1 | BE2 | BE3 | |
| OUTPUTS | L | L | L | L | 1 |
| | H | H | H | H | 2 |
| | H | L | L | L | 3 |
| | L | H | L | L | 4 |
| | L | L | H | L | 5 |
| | L | L | L | H | 6 |

| FIG. 7A |
| --- |
| FIG. 7B |

HEAD, RECORDING APPARATUS HAVING THE HEAD, METHOD FOR IDENTIFYING THE HEAD, AND METHOD FOR GIVING IDENTIFICATION INFORMATION TO THE HEAD

BACKGROUND OF THE INVENTION

1. Field of the Invention

The present invention relates to recording heads and other types of heads used for recording apparatuses, and more particularly, to a recording head having a function for identifying the recording head, a recording apparatus having the recording head, a method for identifying the recording head, and a method for giving identification information to the recording head.

2. Description of the Related Art

The present invention can be applied to apparatuses such as a printer, a copying machine, a facsimile machine having a communication system, and a word processor having a printer all of which perform recording onto recording media, such as paper, thread, fiber, cloth, leather, metal, plastic, glass, wood, and ceramics. The present invention can also be applied to industrial recording apparatuses complexly combined with various processing apparatuses.

"Recording" in the present invention means not only giving a meaningful image such as a character or a figure to a recording medium, but also giving a meaningless image such as a pattern to a recording medium.

Conventional recording apparatuses are configured such that various recording heads and scanner heads can be replaceably mounted, to respond to various demands. As an example of such an apparatus, by preparing a scanner unit for optically reading the original in substantially the same shape as a recording head and using it instead of a printing head, a recording apparatus is used not only for recording but for reading the original. A recording apparatus can also be used for recording with different image quality by mounting another head having a different type of ink.

In another example, to compensate for dispersion in manufacturing recording heads, the best driving condition of a recording head is stored in the recording head when it is manufactured, and a recording apparatus automatically reads and identifies this driving condition to automatically set it.

In yet another example, to reduce cost by using common components in the heads corresponding to a plurality of recording apparatuses, the heads are manufactured in similar shapes. In this case, it is necessary to identify each head so as not to mount an erroneous head to each recording apparatus.

To respond to various demands such as those described above, it is demanded that a recording head be provided with means for identifying more types of recording heads.

Various methods have been used to satisfy such a demand. In a first method, a plurality of identification terminals are provided as terminals for electrically connecting a recording apparatus to a recording head, each of these terminals is grounded or connected to a power supply according to the type of the corresponding recording heads, and the recording head is identified by a low-level signal or a high-level signal. In this method, recording heads of the n-th power of 2 can be identified by providing "n" terminals.

In this method, however, many contacts are needed to identify many recording heads. This not only increases the cost of a recording head and a printing apparatus, but also reduces reliability as the number of contacts increases.

In a second method, electrically multi-level conditions are used in order to identify a plurality of states at one contact. In the simplest method, a resistor is provided for a recording head and the resistance thereof is read by a recording apparatus to identify the head.

In this method, although an identification resistor needs to be provided for a recording head, since it cannot be implemented just by the pattern of a contact, the cost increases. In addition, with dispersion of the contact resistance of a contact being taken into account, it is impossible to largely increase the types of recording heads which can be identified. Furthermore, a recording apparatus needs to have not only just a logic circuit but also an expensive circuit such as an A-D converter.

A third method uses serial data transfer. In this method, a circuit which implements serial transfer is provided for a head. A memory area for identification data is kept in the head and the data is transferred to the recording apparatus.

With this method, since any large amount of identification information can be transferred just by providing three terminals, one for the start pulse of serial transfer, a clock terminal, and a data terminal, in addition to usually required terminals, such as the ground terminal and the power-supply terminal, a number of heads can be identified with this number of terminals. However, because these three terminals are positively required and a serial transfer circuit for identification information is also needed inside the apparatus, the cost thereof increases.

In any of the above methods, a number of terminals are required to give a large amount of identification information to the head, the cost increases, or reliability is not assured.

SUMMARY OF THE INVENTION

Accordingly, it is an object of the present invention to provide a head having a low-cost, highly reliable identification method in which a number of identification terminals are not required and one identification terminal indicates a number of states, an apparatus having the head, the head identification method, and a method for giving identification information to the head.

Another object is to provide a head having many types of identification information, which can be easily mass-produced.

One of the foregoing objects is achieved in one aspect of the present invention through the provision of a head detachably mounted on an apparatus and driven, including: a driving signal line having a driving terminal for receiving a driving signal of the head from the apparatus; and a head identification terminal, wherein the driving signal line is electrically connected to the head identification terminal.

One of the foregoing objects is achieved in another aspect of the present invention through the provision of a recording head for recording with the use of a plurality of recording elements, including: decoding means for receiving a signal from the outside of the recording head, for outputting a larger number of signals than the number of the received signal according to the received signal, and for driving the plurality of recording elements according to the output signals; and a circuit for identifying the type of the recording head, wherein the circuit for identifying the type of the recording head is connected to any of the output signal lines of the decoding means.

One of the foregoing objects is achieved in yet another aspect of the present invention through the provision of an apparatus which can detachably mount a head and drive the head, including: a head provided with a driving signal line having a driving terminal for receiving a driving signal of the head from the apparatus and a head identification terminal electrically connected to the driving signal line; and driving-signal supplying means for sending a driving signal to the driving signal terminal.

One of the foregoing objects is achieved in still another aspect of the present invention through the provision of an apparatus which can detachably mount a recording head and drive the recording head, including: decoding means for receiving a signal from the outside of the recording head, for outputting a larger number of signals than the number of the received signal according to the received signal, and for driving a plurality of recording elements according to the output signals; the recording head connected to any of the output signal lines of the decoding means; and driving-signal supplying means for sending a driving signal to the recording head.

One of the foregoing objects is achieved in a further aspect of the present invention through the provision of a method for giving identification information to a head, including the step of: cutting at least a part of a plurality of patterns used for connecting in a head an identification terminal to a driving signal line having a driving terminal for receiving a driving signal of the head from an apparatus.

One of the foregoing objects is achieved in a still further aspect of the present invention through the provision of a head identification method for identifying a head which includes an identification terminal and a driving signal line having a driving terminal for receiving a driving signal of the head from an apparatus, wherein a signal is sent to the driving terminal of the head; and the head is identified according to the signal read from the identification terminal.

One of the foregoing objects is achieved in a yet further aspect of the present invention through the provision of a recording-head identification method for identifying a recording head, wherein decoding means is provided, for receiving a signal from the outside of the recording head, for outputting a larger number of signals than the number of the received signal according to the received signal, and for driving a plurality of recording elements according to the output signals; a signal input to the decoding means any of whose output signal lines is connected to a circuit for identifying the type of the recording head is changed; and the output signal corresponding to the input signal, obtained from the circuit for identifying the type of the recording head is detected to identify the type of the recording head.

According to the configurations described above, without providing a special circuit, such as a memory or a serial-transfer circuit for identification information, for a head, a head which allows many types of heads to be identified by the use of driving signal lines provided in advance for the head, and an apparatus having the head are provided.

In the above method for identifying a head, many heads can be easily identified by sending a drive signal through a drive signal line and monitoring the output signal of an identification terminal.

In the above method for giving identification information to a head, since identification information is given to a head in which a driving signal line and an identification terminal are connected by a plurality of patterns, just by electrically cutting a part of the plurality of patterns, identification information can be easily given at a low cost.

According to each configuration and method described above, since a signal sent to a head and decoded is used to identify the type of the head, many heads are easily identified without a large change in circuit.

In addition, since a plurality of recording elements, decoding means, and a circuit for identifying the type of a head are mounted on the same element substrate, even a head which allows a plurality of heads to be identified can be made very compact at a low cost.

As described above, according to the present invention, a very large number of units can be identified without providing extra contacts for identification. As a result, a number of optional products can be implemented without reducing reliability and without making an apparatus to a large scale at a low cost.

According to the present invention, with a driving signal line being electrically connected to an identification terminal, a number of heads can be identified with a low number of terminals.

Head identification information can be given to a head just by cutting a pattern connecting a driving signal line to an identification terminal, and a low-cost head can be manufactured in a simple manufacturing process.

BRIEF DESCRIPTION OF THE DRAWINGS

FIG. 5 is a view used for describing pattern cut conditions in an identification circuit.

FIG. 6 is a view showing output results obtained when a signal is sent to the identification circuit four times.

DESCRIPTION OF THE PREFERRED EMBODIMENTS

Figure 1:
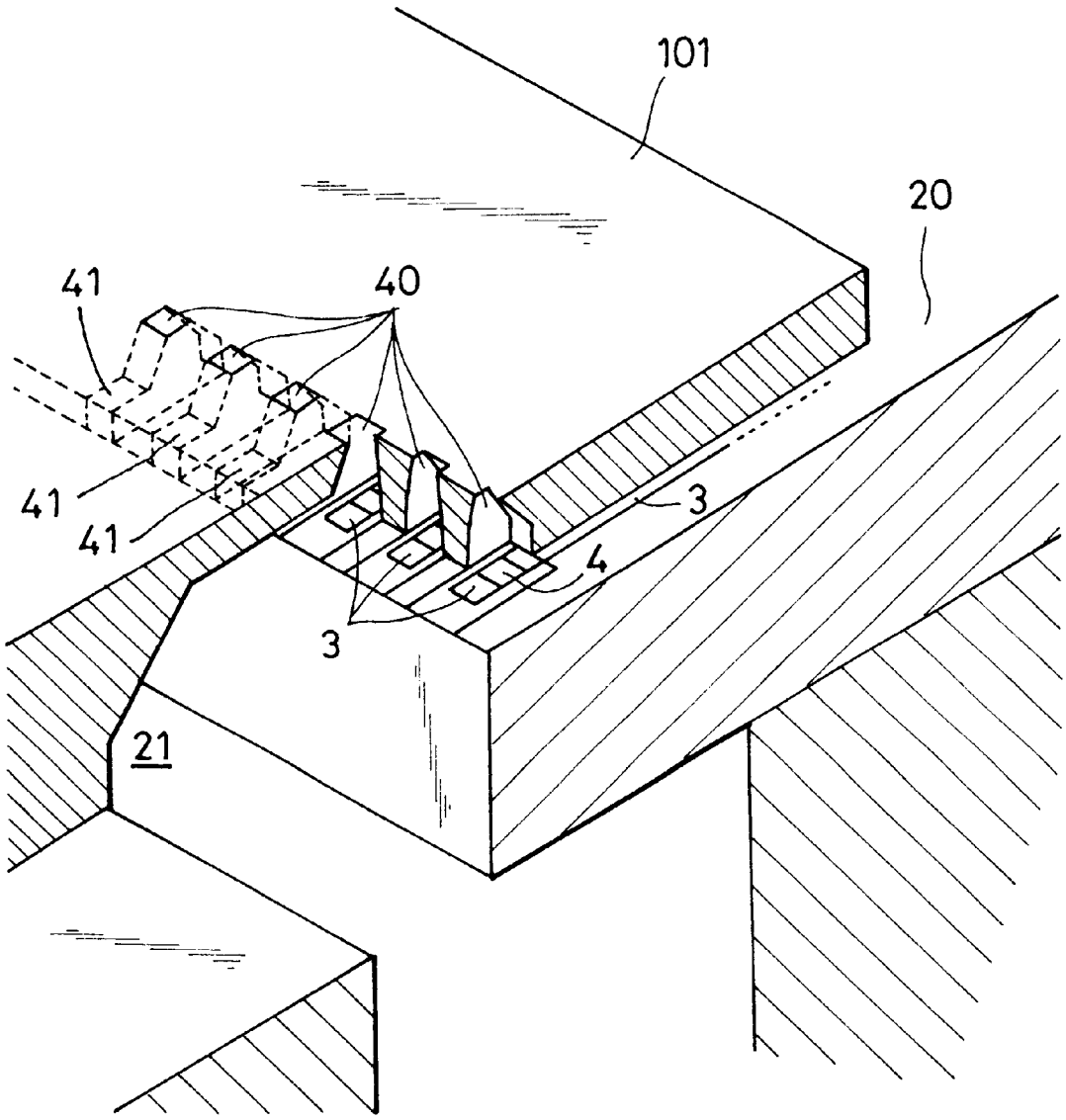
FIG. 1 is an outlined structural view of an ink-jet recording head according to the present invention.

Embodiments of the present invention will be described below by referring to the drawings. "An element base member" used below does not indicate just a base member made from a silicon semiconductor, but means a base member on which an element and a pattern are formed.

"On an element base member" indicates not only "on the element base member" but also at its surface and inside the element base member in the vicinity of its surface.

"Built-in" in the present invention does not mean an arrangement of elements on a base member, but means elements formed and manufactured as a unit on an element base member in a semiconductor-circuit manufacturing process.

By referring to FIG. 1, an outlined structure of an ink-jet recording head will be described below.

On an element base member 20, electrothermal conversion elements 4 (heaters) for discharging ink from discharge outlets 40 by the use of air bubbles generated by heat caused by a received electric signal are arranged in a plurality of columns. Each electrothermal conversion element is provided with a pattern electrode 3 for supplying an electric signal used for driving the electrothermal conversion element. A driving signal line having a driving terminal, and an identification terminal (described later and not shown in FIG. 1) are provided on the element base member 20.

A path 41 for supplying ink to the corresponding discharge output 40 provided at a position opposing an electrothermal conversion element is also provided. A member 101 having grooves is provided with walls used for forming the discharge outlets and paths. The member 101 having grooves is connected to the element base member 20 to form a plurality of paths 41 and a common liquid chamber 21 used for supplying ink to the paths 41.

The element base member 20 in which an identification circuit as well as the electrothermal conversion elements and pattern electrodes are manufactured will be described in the following embodiments.

First Embodiment

Figure 2:
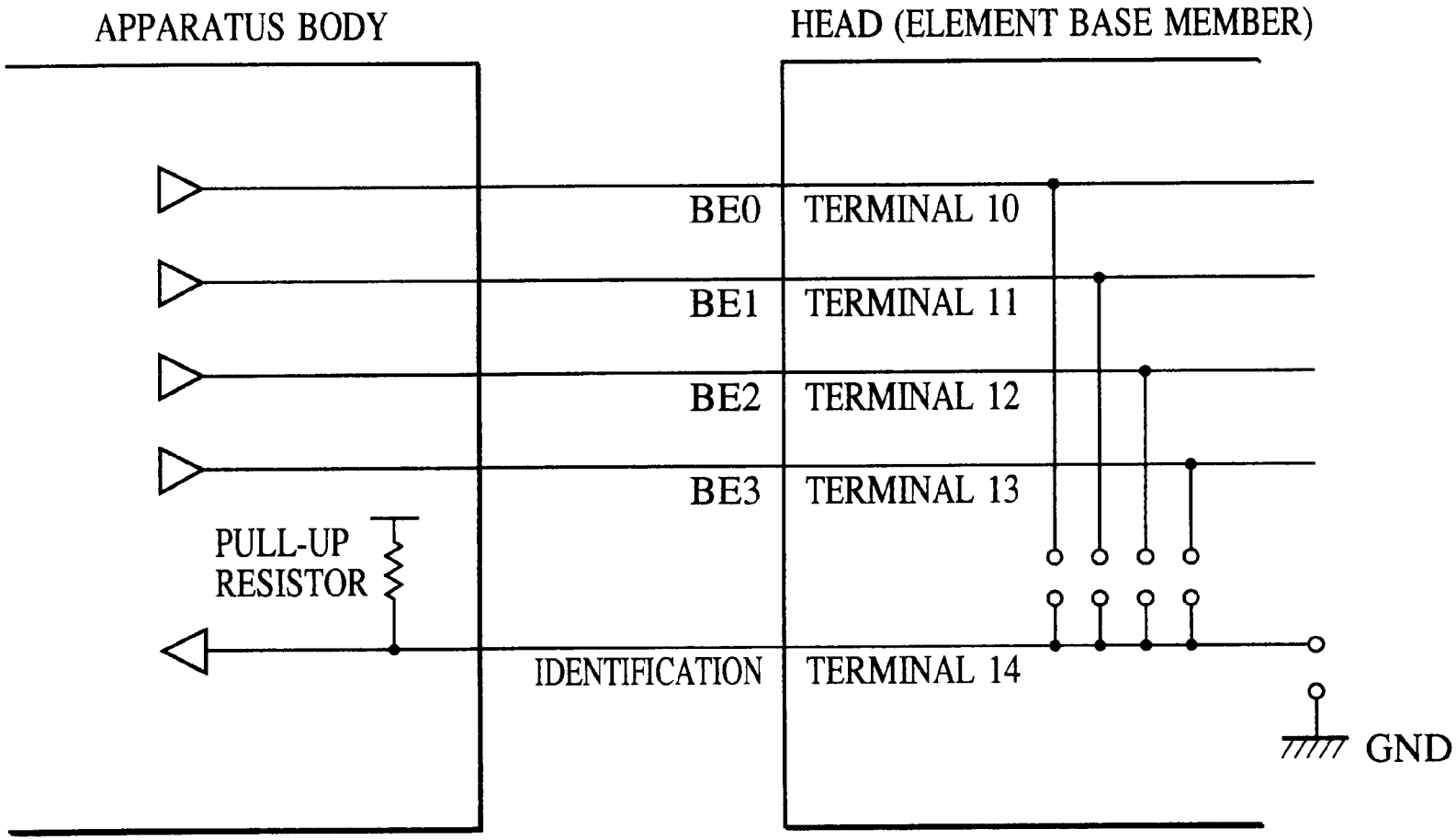
FIG. 2 is a view used for describing connections between an apparatus body and an identification circuit of a head.

FIG. 2 is a view used for describing connections between an apparatus body and the identification circuit of a head according to an embodiment of the present invention.

Figure 3:
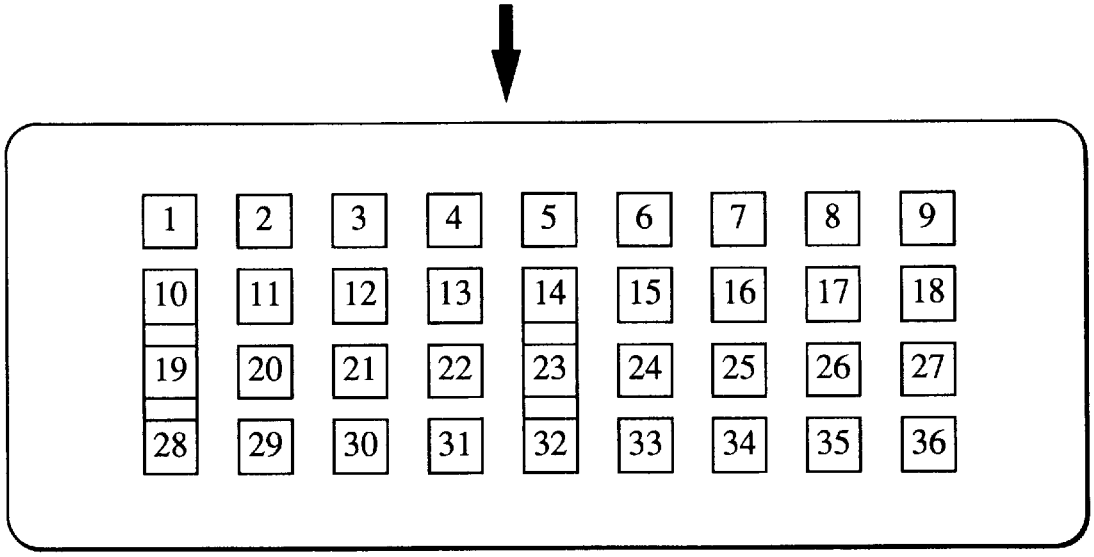
FIG. 3 is a view showing an arrangement of connection terminals (press-fit pad).

FIG. 3 shows an arrangement of press-fit pads serving as driving terminals and identification terminals for connection between the head in which the circuit shown in FIG. 2 is built and the apparatus body. Since the head is provided with three element base members, three types of pads are prepared for a Data1 terminal, a Data2 terminal, a HE terminal, an SHE terminal, a Rank terminal, a Di1A terminal, and a Di2A terminal, each for an A chip, a B chip, and a C chip.

Figures 4, 4A:
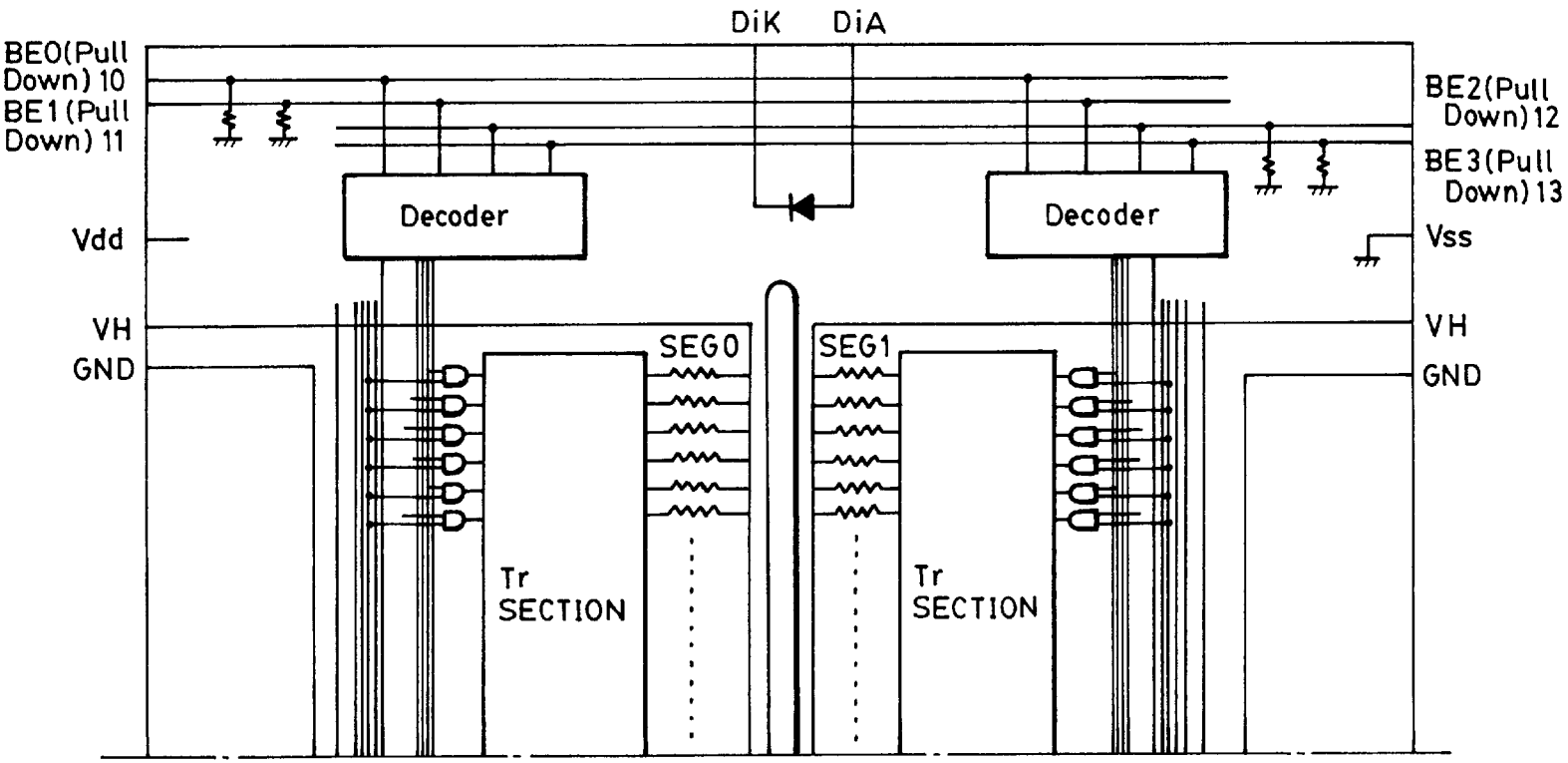
FIG. 4, which consists of FIGS. 4A and 4B, is a view showing an equivalent circuit on an element base member according to the present invention.
Figure 4B:
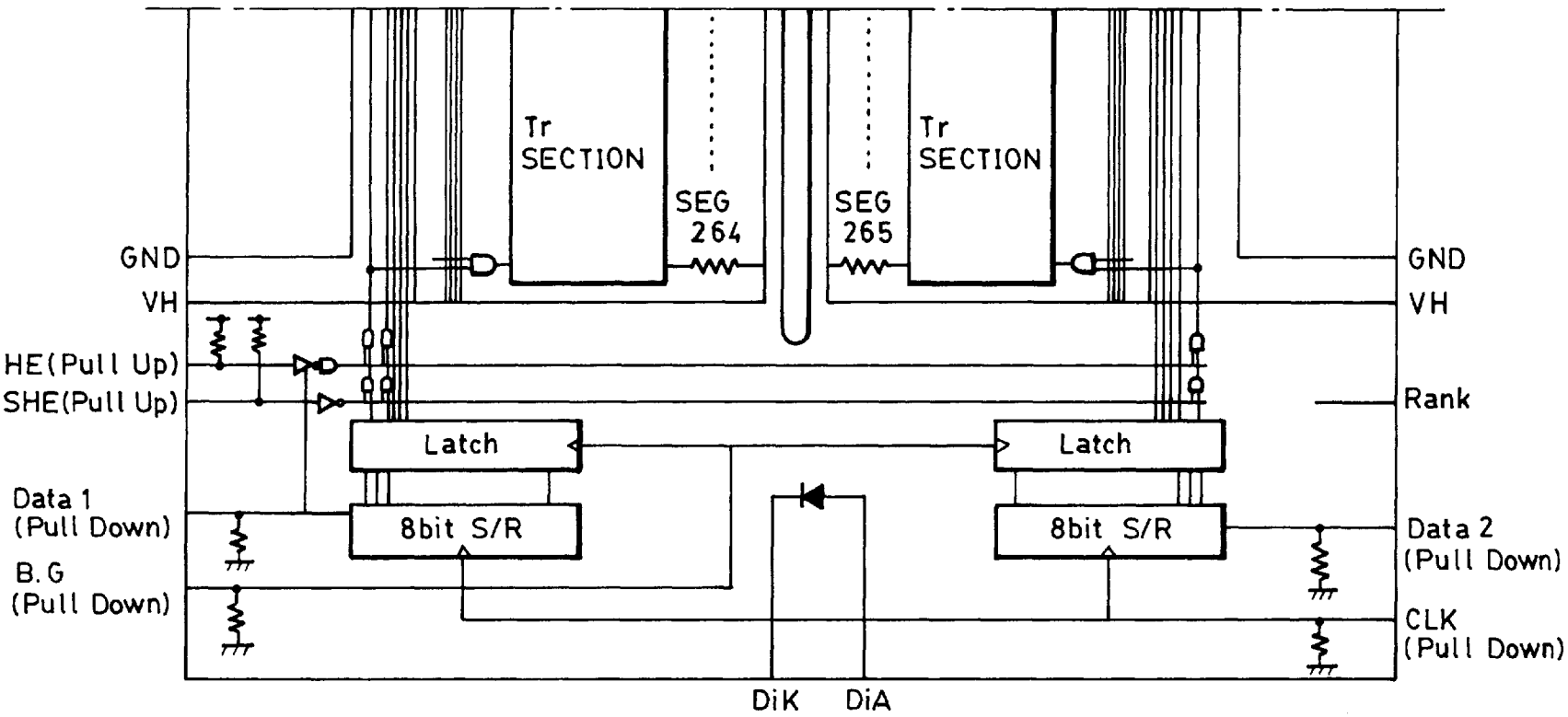

FIG. 4 is a logic diagram of an element base member of the head in which the circuit shown in FIG. 2 is built-in the element base member.

This bubble-jet printing head has two columns (SEG0 to SEG255) of 128 heaters (segments). As described before, nozzles having paths and discharge outlets are provided correspondingly to the heaters. When a number of nozzles are driven at the same time in such a head, which has a number of nozzles, since a very high current flows, it may cause a discharge problem due to a large voltage drop. Therefore, all the nozzles are divided into 16 blocks in this head and a block is selected by four terminals, a BE0 terminal 10, a BE1 terminal 11, a BE2 terminal 12, and a BE3 terminal 13. FIG. 2 shows connections between an identification terminal 14 and these four driving signal lines. The present embodiment corresponds to an identification number 2.

When the head is identified, signals are sequentially sent through the BE0 terminal 10, the BE1 terminal 11, the BE2 terminal 12, and the BE3 terminal 13. The type of the head is identified by the signals read from the identification terminal 14.

When an input terminal in an identification-terminal read unit of a printer body is pulled up, the identification terminal of the head is first read to identify the head. Driving signals are sent to the BE0 to BE3 terminals of the head connected to the identification terminal one by one and the identification terminal is read accordingly. When only one driving signal line is connected to the identification terminal, the state of the read identification terminal is always high, always low (when connected to a ground terminal), or high only when a signal is sent to the connected driving signal line (when the driving signal line is connected).

FIG. 5 shows a relationship between identification numbers and connection states of driving signal lines and the identification terminal 14 of the head. It is understood from this table that all patterns connecting the driving signal lines and the identification terminal are cut in the condition shown in FIG. 2, and it corresponds to the identification number 2.

When the pattern connecting the BE1 driving signal line to the identification terminal is left and the other patterns are cut, the condition corresponds to an identification number 4.

FIG. 6 shows the outputs of the identification terminal 14 obtained when a high-level signal is sequentially sent through the BE0 terminal to the BE3 terminal in four different times. The identification numbers correspond to those shown in FIG. 5.

In the present embodiment, when signals are sent through all signal lines, high-level signals are obtained. This indicates that the head has the identification number 2.

According to the configuration of the present invention, the types of the number of head driving signal lines which can be connected to the identification terminal plus two can be identified, without using a special circuit in the head.

When a pattern on a printed circuit board is used for connections between terminals, the logic circuit is unnecessary. Even if the logic circuit is used, a common pattern can be used for different heads. If all terminals which can be connected to the identification terminal are connected in advance to the identification terminal through patterns, heads having various conditions can be easily mass-produced at a low cost just by cutting or removing a part or all of the patterns.

It is preferred that a signal line used as a connected driving signal line be a signal line through which a signal can be sent before the identification of a head, so as not to drive the head by a head identification signal, and also be a line which does not reduce reliability even if the electrical characteristics of the line, such as a capacitance, change due to a pattern arrangement.

Second Embodiment

Figures 7, 7A:
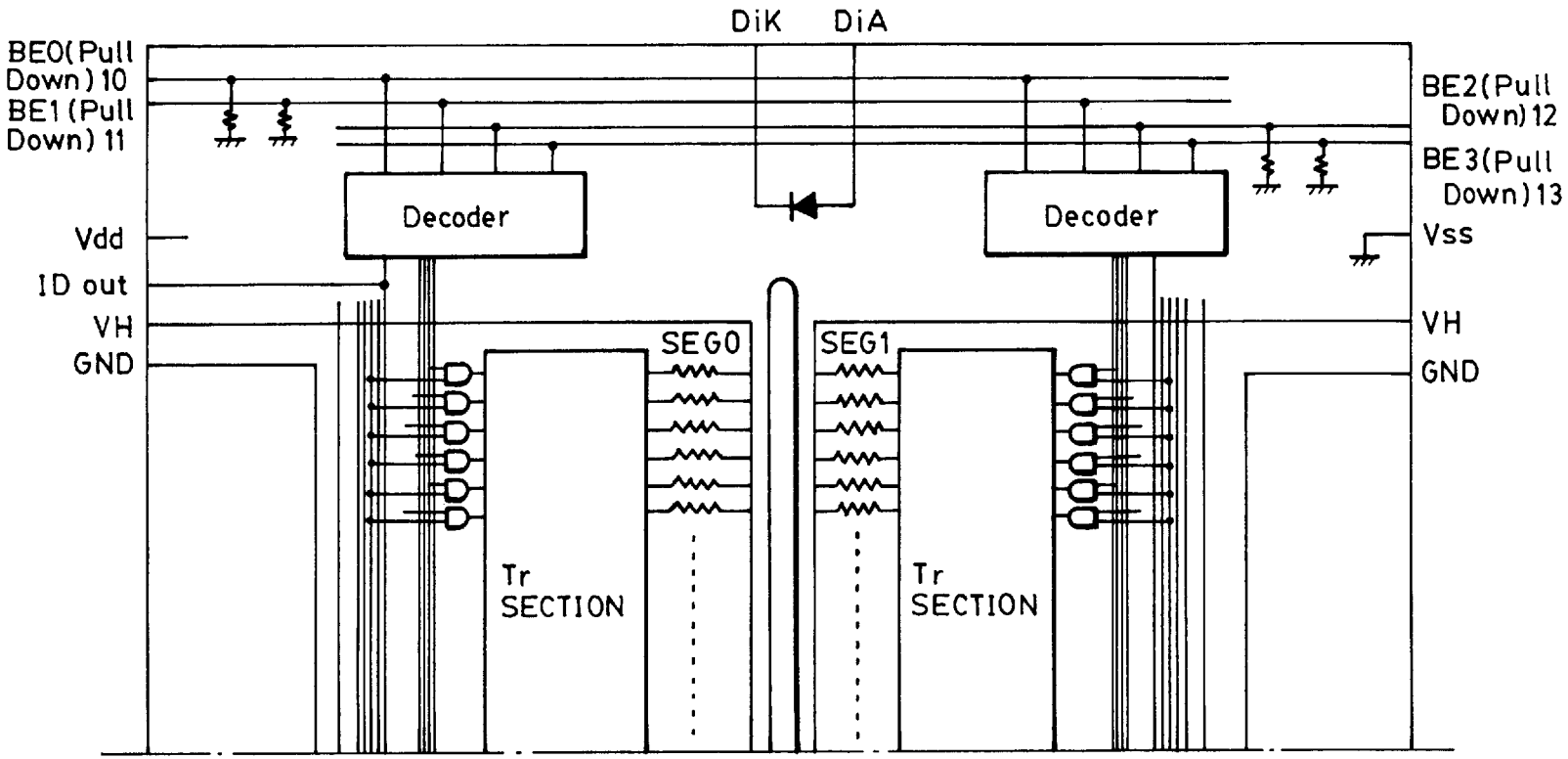
FIG. 7, which consists of FIGS. 7A and 7B, is a view showing another equivalent circuit on an element base member according to the present invention.
Figure 7B:
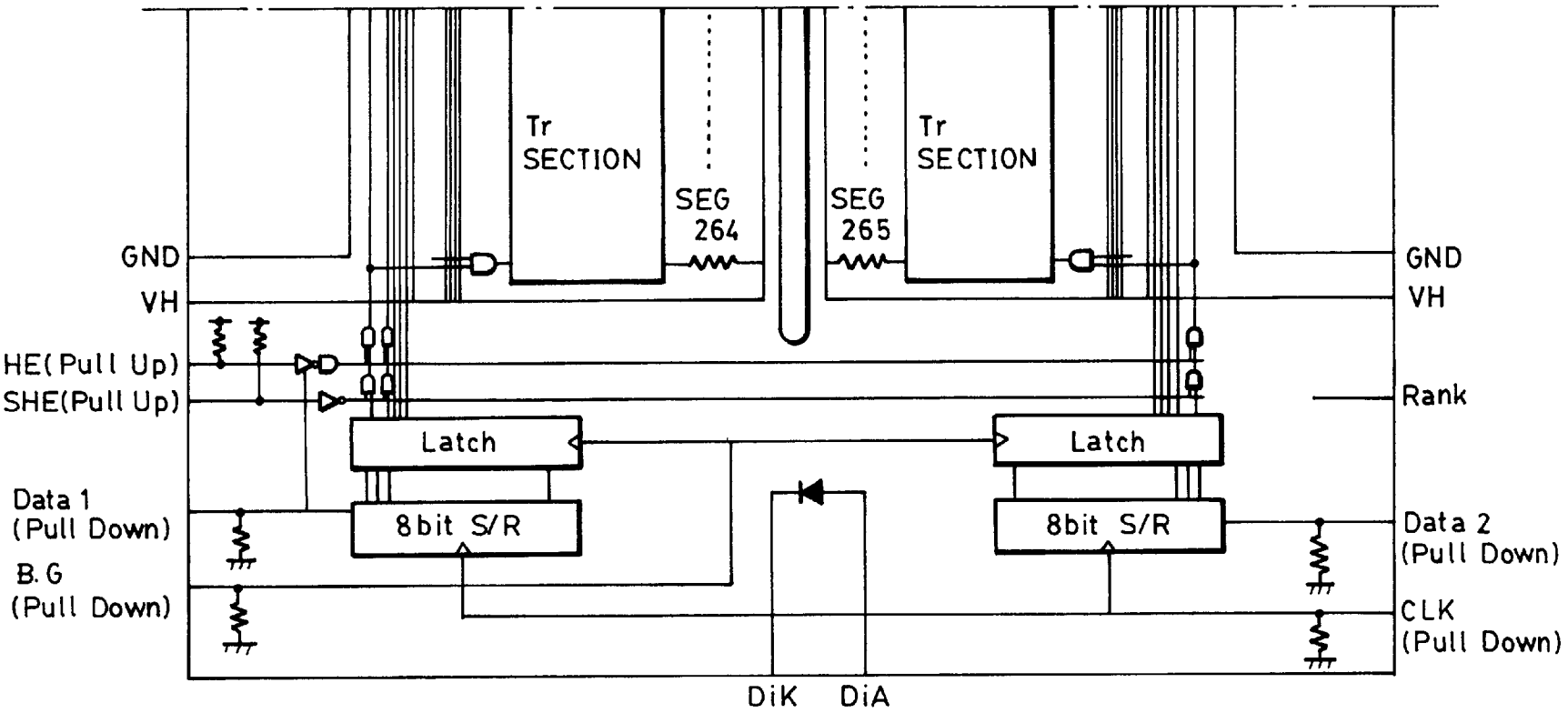

FIG. 7 is a logic diagram which differs from that shown in FIG. 4 in that the output of the decoding circuit is connected to the identification terminal 14. With this connection, the states of the fourth power of 2 plus 2 (a total of 18) can be identified although only the BE0 terminal 10 to the BE3 terminal 13 are used as signal terminals in the same way as in the first embodiment. Signals are output from the four terminals, the BE0 terminal 11 to the BE3 terminal 13, at the same time, and a signal level is changed sequentially at each terminal to send 16 types of signals. In the present embodiment, since n driving terminals are connected to the identification terminal through the decoding circuit in the head, when a signal is sent through one or more driving terminals at the same time, the terminal through which a signal is sent is sequentially changed, and the signal is read each time, the types of the n-th power of 2 plus 2 can be identified with a case in which a line is grounded and a case in which a line is pulled up and not connected being added.

The identification information input terminal of the body may be pulled down, instead of pulled up. In this case, the identification terminal is connected to the power supply, not to the ground line.

Third Embodiment

In the above embodiments, one identification terminal is used. A plurality of identification terminals may be used.

If two identification terminals are used in the first embodiment, since six types can be identified by one identification terminal, 36 types (six multiplied by six) can be identified.

Fourth Embodiment

Figure 8:
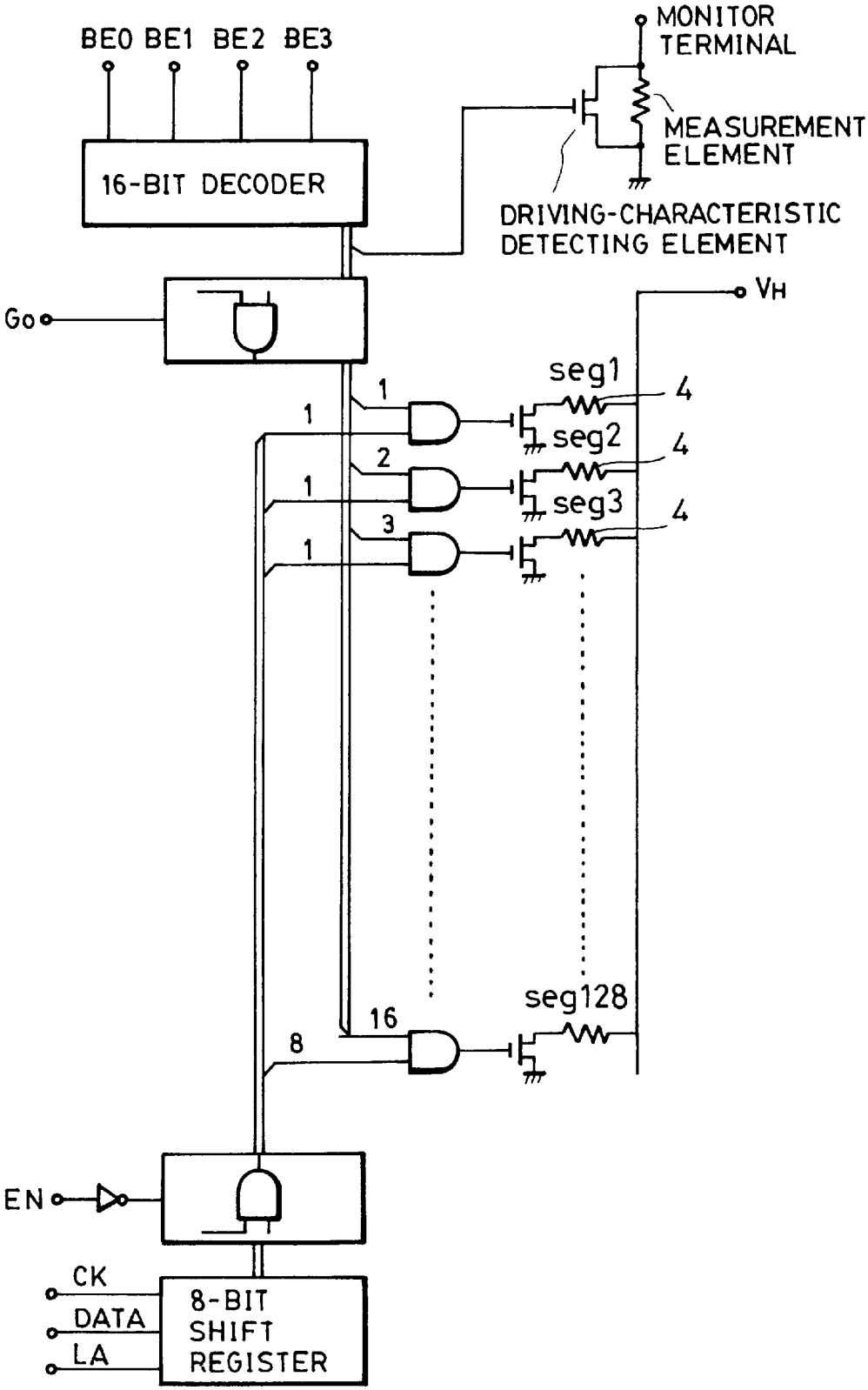
FIG. 8 is a view used for describing a circuit configuration of a main section on an element base member according to the present invention.

FIG. 8 shows an equivalent circuit of a main section on an element base member according to the present invention.

In this embodiment, 128 heating (heat generating) elements (seg1 to seg128) serving as recording elements are independently driven. The 128 heating elements have a matrix structure of 16 by 8, and eight elements are driven at the same time. Data is input to a shift register in units of eight bits. When BE0, BE1, BE2, and BE3 signals are input to a decoder as input signals, signals are output through 16 output signal lines. The output signal data specifies the nozzle to be driven. When an EN signal is low and a GO signal is low, heating elements are actually driven. With these signals, the time in which a current flows into heating elements is controlled.

As disclosed in Japanese Patent Application No. 8-202077, a measurement element and a driving-characteristic detecting element which are formed at the same time as when the heating elements are formed are provided for one monitor terminal on the element base member, and used as an identification circuit for identifying the type of the head in the present embodiment. The identification circuit is connected to one of the 16 output signals formed by decoding the BE0, BE1, BE2, and BE3 signals. According to which signal is connected among the 16 signals, 16 types can be identified.

Figure 9:
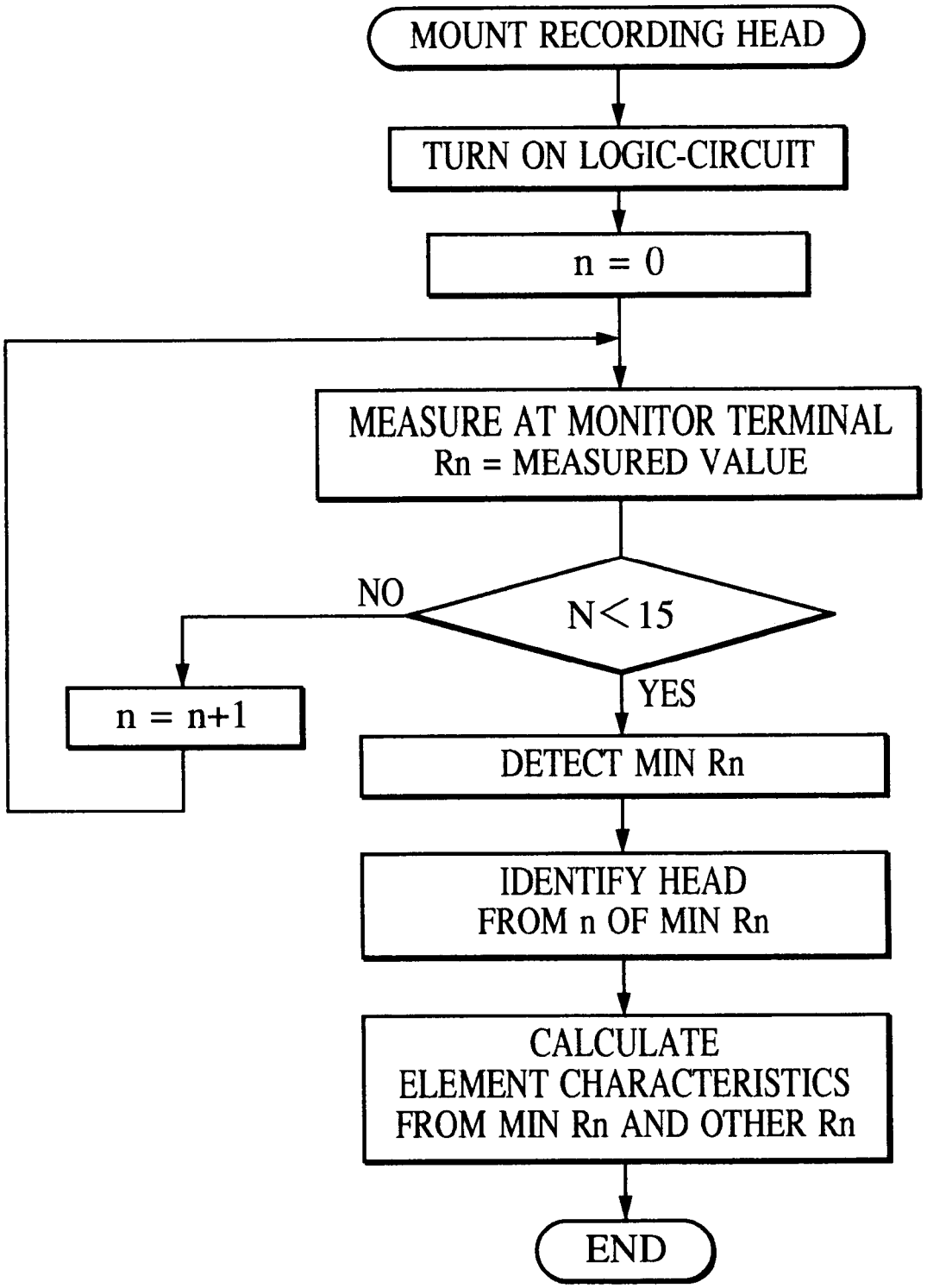
FIG. 9 is a flowchart of a head identification sequence according to the present invention.

When the recording head is mounted on a printing apparatus, the printing apparatus sequentially sends signals through the BE0, BE1, BE2, and BE3 lines to measure the resistance of the measurement element terminal. A low resistance reads only when a certain signal is sent among the BE0, BE1, BE2, and BE3 signals. The printing apparatus can obtain the characteristics of the measurement element and the driving-characteristic detecting element by calculating the high resistance and the low resistance. According to which signal causes the low resistance, namely, when the driving-characteristic detecting element is turned on, 16 types can be identified. FIG. 9 is a flowchart for this identification. Even if it takes about 100 $\mu$s to measure the resistance of the monitor terminal, since the number of measurements required for identification is just 16, the identification can be finished within 2 ms.

The above signals, sent from the printing apparatus to the recording head, are used for time-division driving and not for driving heating elements. Therefore, an inappropriate driving signal is not given and a recording-head problem is not caused.

Instead of the signals obtained by decoding the BE0, BE1, BE2, and BE3 signals, one of the BE0, BE1, BE2, and BE3 may be connected to the driving-characteristic detecting element. In this case, among the 16 combinations of signals sent through the BE0, BE1, BE2, and BE3, eight combinations which turn the element on are used for identification. When this method is used together with the above method, 20 types can be identified.

In the present embodiment, the measurement element for detecting the characteristics of a heating element and the driving-characteristic detecting element for detecting driving characteristics are used as the identification circuit. It is a matter of course that only a signal lead terminal may be connected to one of the 16 output signals, apart from the circuit formed of both elements for detecting the characteristics.

In the present embodiment, a new circuit is not required for the identification function, and a number of recording heads can be identified just by changing the patterns on the element base member inside the recording head. Especially when the circuit inside the recording head is integrated into a chip, a number of recording heads can be identifiably manufactured just by changing a pattern mask used in an IC manufacturing process.

Fifth Embodiment

The fifth embodiment uses a circuit similar to that shown in the first embodiment. According to the four bits input of BE0, BEE, BE2, and BE3 signals, any combinations thereof are assigned to turning on and off of a driving-characteristic detecting element to generate a number of combinations, and thereby a number of types are allowed to be identified.

Figure 10:
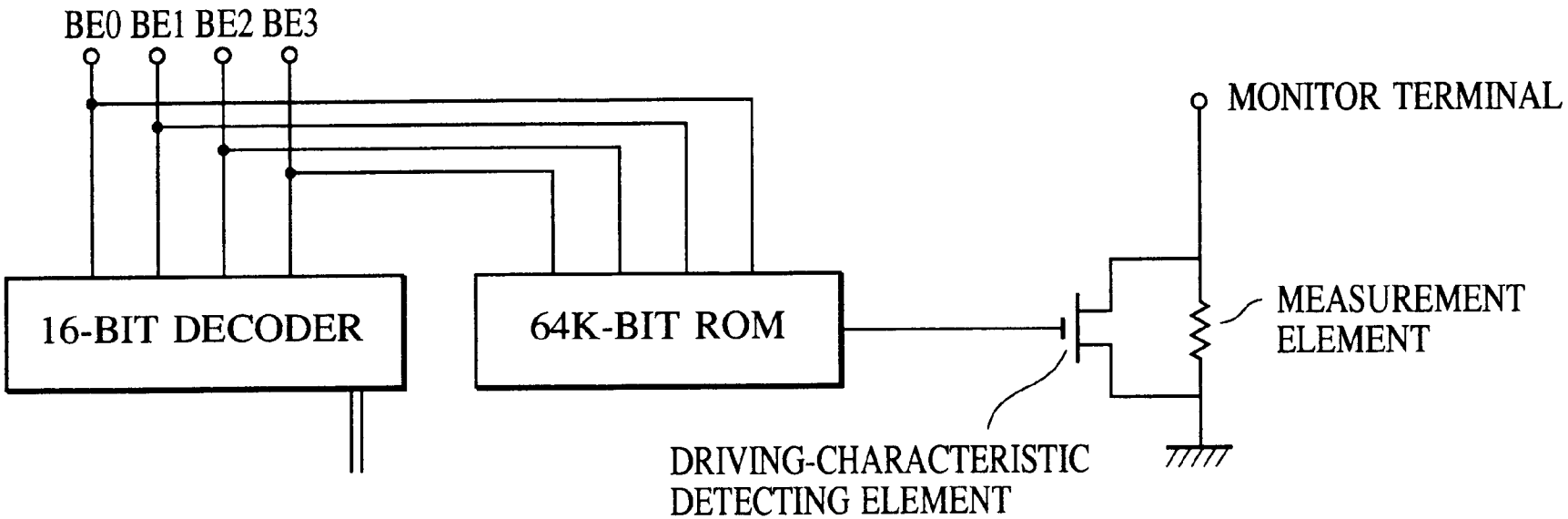
FIG. 10 is a view used for describing another head identification circuit according to the present invention.

As shown in FIG. 10, an four-bit input corresponds to 16 input signals. When turning on and off of a driving-characteristic detecting element are determined according to the input signals, the 16th power of 2, namely, 65536, of combinations can be generated. If the two states, ON and OFF, of all signals are used for identification, the conditions of a measurement element and the driving-characteristic detecting element cannot be measured. Therefore, it is impossible to use the two states of all the signals, but other situations are possible, which allow 65534 recording heads to be identified. If the conditions of the measurement element and the driving-characteristic detecting element need not be measured, the two states required for these measurements can be used for other purposes.

A circuit for determining the on and off states of a driving-characteristic detecting element according to 16 inputs can be easily implemented by the use of a ROM, as shown in FIG. 10. A special logic circuit may be provided for each recording head. A signal can be taken out from the inside circuit of a decoder.

As compared with the first embodiment, the present embodiment requires an extra circuit, but a very large number of heads can be identified without increasing external terminals. The monitor terminal is measured the same number of times as in the first embodiment, so it does not take more time for identification.

Sixth Embodiment

In the second embodiment, the four BE signals are used for dividing the heating elements into 16 blocks. Other division numbers may be used. For example, if the heating elements are divided into eight groups, three BE signals are required. Eight types can be identified in the method shown in the first embodiment, and 254 types can be identified in the method shown in the second embodiment.

In a unit compatible with a recording head, such as a scanner which can be mounted on a carriage of a printing apparatus, when a monitor terminal, a BE terminal or the corresponding terminal thereto, a power supply terminal for driving a logic circuit, and a ground terminal are set common, the other terminals can be set in any way.

As an identification terminal, the monitor terminal for monitoring the measurement element used for detecting the characteristics of a heating element and the driving-characteristic detecting element used for detecting the characteristics of a transistor is used in the above embodiments. A terminal may be formed independently.

Figure 11:
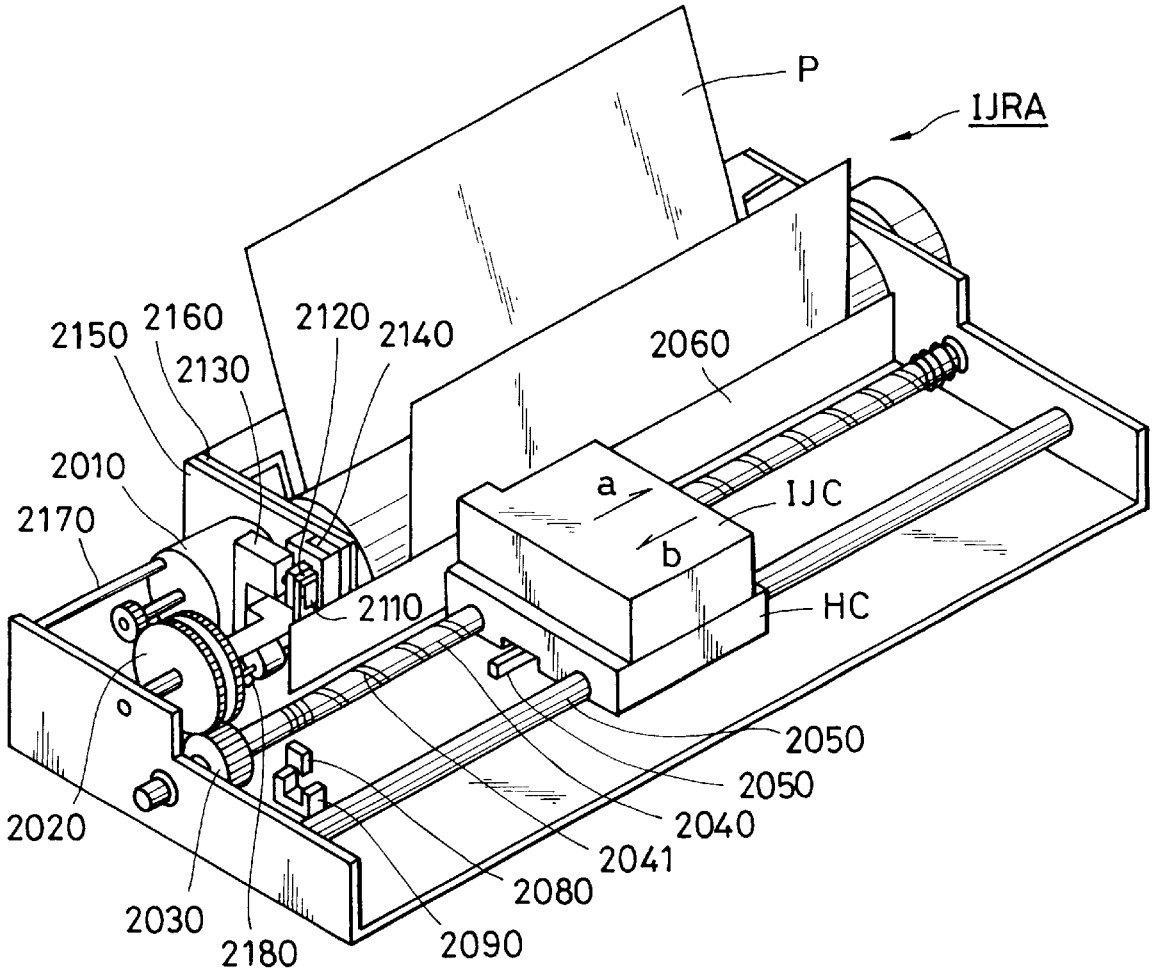
FIG. 11 is a perspective view of a recording apparatus according to the present invention.

FIG. 11 is a perspective view of an ink-jet recording apparatus on which an ink-jet recording head configured as described above is mounted. This ink-jet recording apparatus IJRA has a lead screw 2040 which rotates correspondingly to the forward and reverse rotation of a driving motor 2010 through driving-force transmission gears 2020 and 2030. A carriage HC on which an ink-jet cartridge IJC in which an ink-jet recording head and an ink tank are integrated is placed is supported by a carriage shaft 2050 and the lead screw 2040, has a pin (not shown) which is engaged with a helical groove 2041 of the lead screw 2040, and reciprocates in the directions indicated by arrows "a" and "b" correspondingly to the rotation of the lead screw 2040. A paper holding plate 2060 presses against a platen roller 2070 which constitutes transfer means for transferring a recording medium, paper P, along the carriage movement directions. Optocouplers 2080 and 2090 operate as home-position detecting means for detecting a lever 2100 provided for the carriage HC in this area to change the rotation direction of the motor 2010. A cap member 2110 covers the whole surface of the recording head and is supported by a supporting member 2120. Absorbing means 2130 absorbs the recording head for recovery through an opening in the cap member. A cleaning blade 2140 for cleaning an end face of the recording head is provided for a member 2150 which can move back and forth. The member 2150 is supported by a body supporting plate 2160. The blade 2140 is not limited to that shown in FIG. 1 and a known cleaning blade can be also used in the present invention. A lever 2170 for recovering the absorption moves correspondingly to the movement of a cam 2180 engaged with the carriage HC. With this, the driving force of the driving motor 2010 is controlled by known transmission means such as clutch switching.

The above capping, cleaning, and absorption recovery are performed at the corresponding positions by the lead screw 2040 when the carriage HC comes to the home position area. If these operations are set to be performed at a known timing, no problem occurs.

In the above embodiments, the recording head is taken as an example. For a unit compatible with a recording head, such as a scanner head, a different signal needs to be generated at a terminal used for identifying the unit, correspondingly to the signal terminals for the recording head.

An identification terminal not necessarily serves as a special terminal for identification. A terminal for monitoring the characteristics of a heating element provided for each nozzle and the characteristics of a transistor used for driving each nozzle may be used as an identification terminal.

When the method in which a single terminal is used for monitoring the characteristics of a heating element and the characteristics of a transistor used for driving the heating element is applied to the present invention, a very large number of recording heads or compatible heads can be identified without increasing terminals.

What is claimed is:

1. A head detachably mounted on an apparatus and driven by the apparatus, comprising:

a block enable signal line having an enable terminal for receiving from the apparatus an enable signal for selecting a block of recording elements of said head to be selected and driven;

a head identification terminal for transmitting identification signals between said head and said apparatus; and a printed circuit board on which said enable terminal and said head identification terminal are provided and electrically connected to the apparatus, wherein a circuit for identifying said head by electrically connecting or disconnecting said enable terminal and said head identification terminal is provided on said printed circuit board.

2. A head according to claim 1, wherein said plurality of recording elements generate heat according to the driving signal.

3. A head according to claim 1, wherein said head identification terminal and said enable terminal are connected with a pattern on said printed circuit board.

4. A head according to claim 1, further comprising a decoding circuit, wherein two or more head enable signal lines are connected to said decoding circuit and the output lines of the decoding circuit are electrically connected to said head identification terminal.

5. An apparatus which is adapted to detachably mount a head and drive the head, comprising:

a head provided with a block enable signal line having an enable terminal for receiving from said apparatus an enable signal for selecting a block of recording elements of said head to be driven and a head identification terminal, for transmitting identification signals between said head and said apparatus; and block enable signal supplying means for sending a block enable signal to said enable terminal, wherein said head has a printed circuit board for electrically connecting an apparatus side, on which a circuit is provided for identifying said head by electrically connecting or disconnecting said enable terminal and said head identification terminal.

6. An apparatus according to claim 5, wherein the head identification terminal and said enable terminal are connected with a pattern on a printed circuit board.

7. An apparatus according to claim 5, wherein said head includes a decoding circuit, two or more enable signal lines are connected to the decoding circuit, and the output lines of the decoding circuit are electrically connected to the identification terminal.

* * * * *